US008514038B2

(12) United States Patent
Weigt et al.

(10) Patent No.: US 8,514,038 B2
(45) Date of Patent: Aug. 20, 2013

(54) STARTER RELAY OF A STARTER DEVICE FOR INTERNAL COMBUSTION ENGINES

(75) Inventors: Josef Weigt, Vaihingen (DE); Houman Ramezanian, Ennetbuden (CH); Raphael Schymura, Oberriexingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/259,338

(22) PCT Filed: Mar. 22, 2010

(86) PCT No.: PCT/EP2010/053666

§ 371 (c)(1), (2), (4) Date: Dec. 9, 2011

(87) PCT Pub. No.: WO2010/108878

PCT Pub. Date: Sep. 30, 2010

(65) Prior Publication Data

US 2012/0098629 A1 Apr. 26, 2012

(30) Foreign Application Priority Data

Mar. 23, 2009 (DE) ..... 10 2009 001 725

(51) Int. Cl.
*H01H 67/02* (2006.01)

(52) U.S. Cl.
USPC ..... 335/126

(58) Field of Classification Search
USPC ..... 335/126, 131
See application file for complete search history.

(56) References Cited

U.S. PATENT DOCUMENTS

| | | | | |
|---|---|---|---|---|
| 4,604,597 | A * | 8/1986 | Bogner et al. | 335/127 |
| 4,755,781 | A | 7/1988 | Bogner | |
| 5,222,401 | A * | 6/1993 | Fasola et al. | 74/7 A |
| 6,552,638 | B2 | 4/2003 | Rhodes | |
| 6,693,503 | B1 * | 2/2004 | Nguyen et al. | 335/131 |
| 6,762,663 | B2 * | 7/2004 | Andoh et al. | 335/126 |
| 7,038,563 | B2 * | 5/2006 | Andoh et al. | 335/126 |
| 2002/0005771 | A1 | 1/2002 | Rhodes | |

FOREIGN PATENT DOCUMENTS

| | | |
|---|---|---|
| DE | 3918351 | 12/1989 |
| DE | 19814504 | 6/1999 |
| DE | 10260843 | 7/2004 |

(Continued)

OTHER PUBLICATIONS

PCT/EP2010/053666 International Search Report (2 pages).

*Primary Examiner* — Alexander Talpalatski
(74) *Attorney, Agent, or Firm* — Michael Best & Friedrich LLP

(57) ABSTRACT

The invention relates to a starter relay (19) for internal combustion engines, comprising a relay coil (27) and an armature (20), which interacts with a fork lever (21) by way of a driver (24) so as to toe-in a starter pinion, and comprising a contact bridge (34) which is to be actuated by the armature by way of a switch axis (32) and interacts with switch contacts (23*a*), wherein a coupling (33*b*) connects the switch axis and the armature such that they can be displaced with respect to each other to a limited extent. In order to ensure that welded contacts tear open and the neutral position of the fork lever is achieved when the relay is shut off, a pretensioned compression spring (26) is inserted between the armature (20) and the end of the fork lever (21).

6 Claims, 4 Drawing Sheets

(56) References Cited

FOREIGN PATENT DOCUMENTS

| | | |
|---|---|---|
| FR | 2488041 | 2/1982 |
| JP | 07077142 | 3/1995 |
| JP | 2001323862 | 11/2001 |

* cited by examiner

STARTER RELAY OF A STARTER DEVICE FOR INTERNAL COMBUSTION ENGINES

PRIOR ART

The invention relates to a starter relay of a starting device for internal combustion engines of the type indicated in claim 1.

German Laid-Open Application DE 199 51 116 A1 has disclosed a relay for a starting device of internal combustion engines in which a coupling element connects the switching rod of the relay and the magnet armature in a manner which allows limited displacement. This coupling element is used to break apart the contact bridge and the switching contacts of the relay from the magnet armature, which is accelerated by an armature reset spring, when the relay is switched off, if said bridge and armature weld together. However, this function of the coupling element is limited by manufacturing and adjustment tolerances of the starter relay and of the engagement mechanism for the starter pinion of the starting device. Two critical cases can arise in this context, depending on the design of the coupling element. On the one hand, the welded contacts are not broken apart if the air gap between the magnet armature and the magnet core of the relay in the rest condition is too small, because the magnet armature presses the engagement device against a rest stop by way of a forked lever before the driver of the magnet armature can actuate the coupling element. On the other hand, the magnet armature reaches its rest position, which is defined by way of the coupling element by means of a rest stop on the switching spindle, before the engagement device of the starting device can be pushed into its rest position by way of the forked lever and, as a result, the starter pinion may not be reliably disengaged.

It is the aim of the present solution to ensure that breaking apart of welded switching contacts of the relay and return of the engagement device to a rest stop when the starter relay is switched off is ensured in all cases.

DISCLOSURE OF THE INVENTION

The starter relay according to the invention, having the features stated in the characterizing part of claim 1, has the advantage over the prior art that the coupling element can be dimensioned in such a way, over the entire range of manufacturing and adjustment tolerances, that, on the one hand, welded contacts break apart when the relay is switched off and, on the other hand, that the engagement device of the starting device is pressed against its rest stop by way of the forked lever in the rest position of the magnet armature. Whereas the rest position of the magnet armature is defined as before by way of the coupling element, by means of a rest stop on the switching spindle, the forked lever is now additionally pivoted back with the aid of the compression spring according to the invention until, as a result, the engagement device of the starting device is resting securely against its rest stop, this being achieved in a simple and reliable manner. Another advantage of the solution according to the invention is that, owing to the absence of an idle travel between the head of the forked lever and the punched window in the driver, the starter pinion is engaged more quickly and that furthermore the temperature-dependent functional limit on the starter relay is raised by virtue of the magnetic initial force since the working air gap of the magnet armature can be reduced through the absence of an idle travel in the punched aperture in the driver and it is thus possible to increase the magnetic force at the beginning of the armature travel.

Admittedly, Patent Application U.S. 2002/000 5771 A1 has already disclosed a starting device for internal combustion engines having a starter relay in which the free end of a driver secured on the magnet armature has arranged on it a compression spring which acts on the forked lever for the engagement mechanism. However, the rear end of this compression spring is supported on the housing of the starter relay and the spring thus performs the function of an armature reset spring.

The measures presented in the subclaims result in advantageous developments and improvements of the features indicated in the main claim. To achieve optimum engagement dynamics of the starting device, it is expedient if the pressure force of the compression spring is greater in the rest position of the starter relay than the resetting force of the armature reset spring because play between the forked lever and the driver of the magnet armature is thereby avoided. It is furthermore advantageous, for the purpose of switching off the starting device when an engaged starter pinion has become stuck, if the pressure force of the compression spring in the switched-on position of the magnet armature is less than the resetting force of the contact and armature reset springs then acting on the magnet armature, thus ensuring that at least the starter motor is then switched off by the starter relay.

In the simplest case, the compression spring is a helical compression spring mounted axially on the end region of the driver. To avoid modifications in the design of the driver, the helical compression spring is advantageously supported at one end, via a cupped washer, on a head of the forked lever, said head projecting into a punched aperture in the end section of the driver, and is supported at its other end on the end face of the magnet armature. In order to be able to pre-mount the helical compression spring together with the cupped washer on the starter relay in a captive manner without the forked lever, a finger, which reaches from above through the punched aperture in the driver, is expediently punched out in the central area of the cupped washer, with the result that, in the pre-mounted state, the cupped washer is supported against the outer end wall of the punched window in the driver with the preloading force of the helical compression spring.

BRIEF DESCRIPTION OF THE DRAWINGS

The invention is explained in greater detail below by way of example with reference to the figures, of which.

EMBODIMENTS OF THE INVENTION

Figure 1:
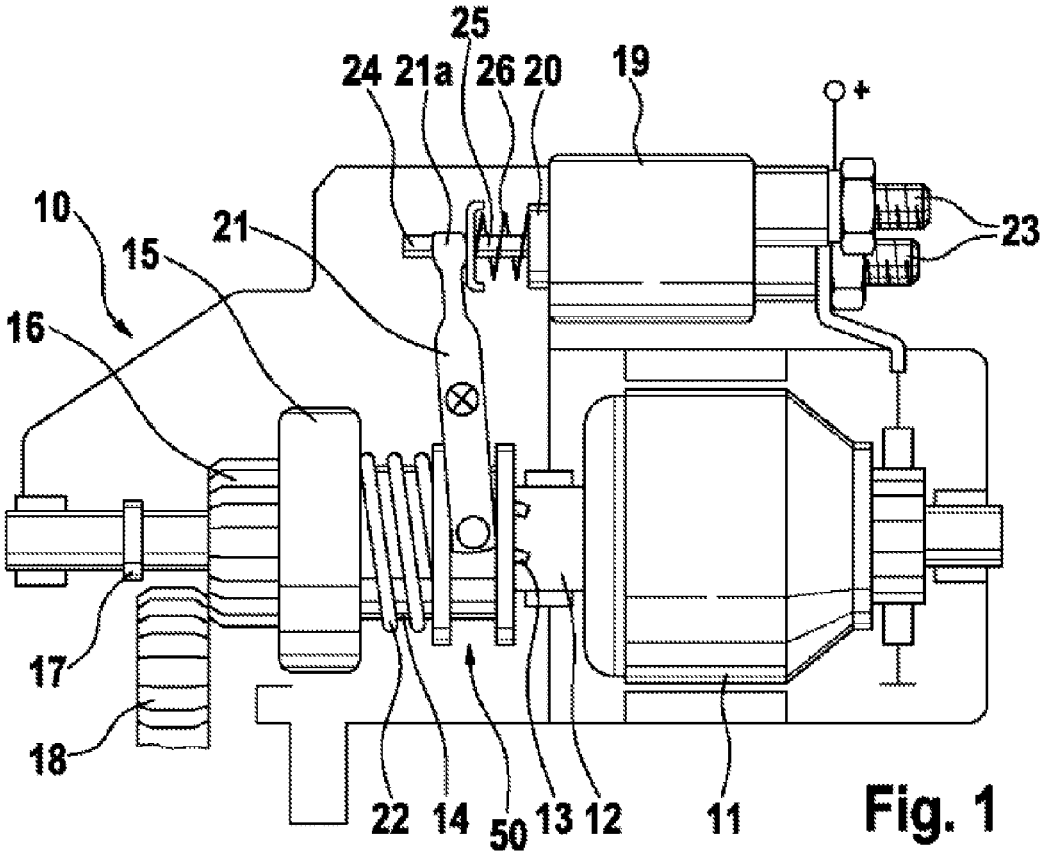
FIG. 1 shows a starting device for internal combustion engines having a starter relay in schematic representation.

FIG. 1 shows the schematic structure of a starting device 10 for internal combustion engines. The starting device 10 has a starter motor 11, the drive shaft 12 of which has a steep-pitch thread 13, which interacts with a corresponding nut thread in a driver shaft 14. As an alternative, the drive shaft 12 is driven by the starter motor 11 by way of an interposed planetary transmission (not shown). The driver shaft 14 is securely connected to the outer ring of a one-way clutch 15, the inner ring of which carries a starter pinion 16 at the front end. The starter pinion 16 and the one-way clutch 15 are mounted on the drive shaft 12 in such a way that they can be displaced as far as a stop 17, on the one hand, and as far as the end of the steep-pitch thread 13, on the other hand. In the process, the starter pinion 16 is engaged in a ring gear 18 of the internal combustion engine (not shown). The axial displacement is accomplished with the aid of a starter relay 19, the magnet armature 20 of which engages on the one-way clutch 15 by way of a forked lever 21 and an engagement spring 22. The starter motor 11 is likewise supplied with power via the starter relay 19, the contact studs 23 of which are connected, on the one hand, to the positive potential of the vehicle battery (not shown) and, on the other hand, to the starter motor 11. The forked lever 21 is actuated by way of a driver 24 projecting axially outwards from the magnet armature in order to preengage the starter pinion 16. The head end 21*a* of the forked lever 21 projects into a punched aperture 25 in the driver. A preloaded compression spring 26 designed as a helical spring is inserted between the magnet armature 20 and the head end 21*a* of the forked lever 21. With the starter relay 19 switched off, it pushes an engagement device 50 consisting of steep-pitch thread 13, driver shaft 14, forked lever 21 and engagement spring 22 into the rest position shown. To start the internal combustion engine, the magnet armature 20 is pulled in when the starter relay 19 is switched on, and the starter pinion 16 is thus engaged in the ring gear 18 by way of the forked lever 21. In the last part of the armature travel, the switching contacts of the starter relay are furthermore closed, thus switching on the starter motor 11 in order to crank the internal combustion engine.

Figure 2:
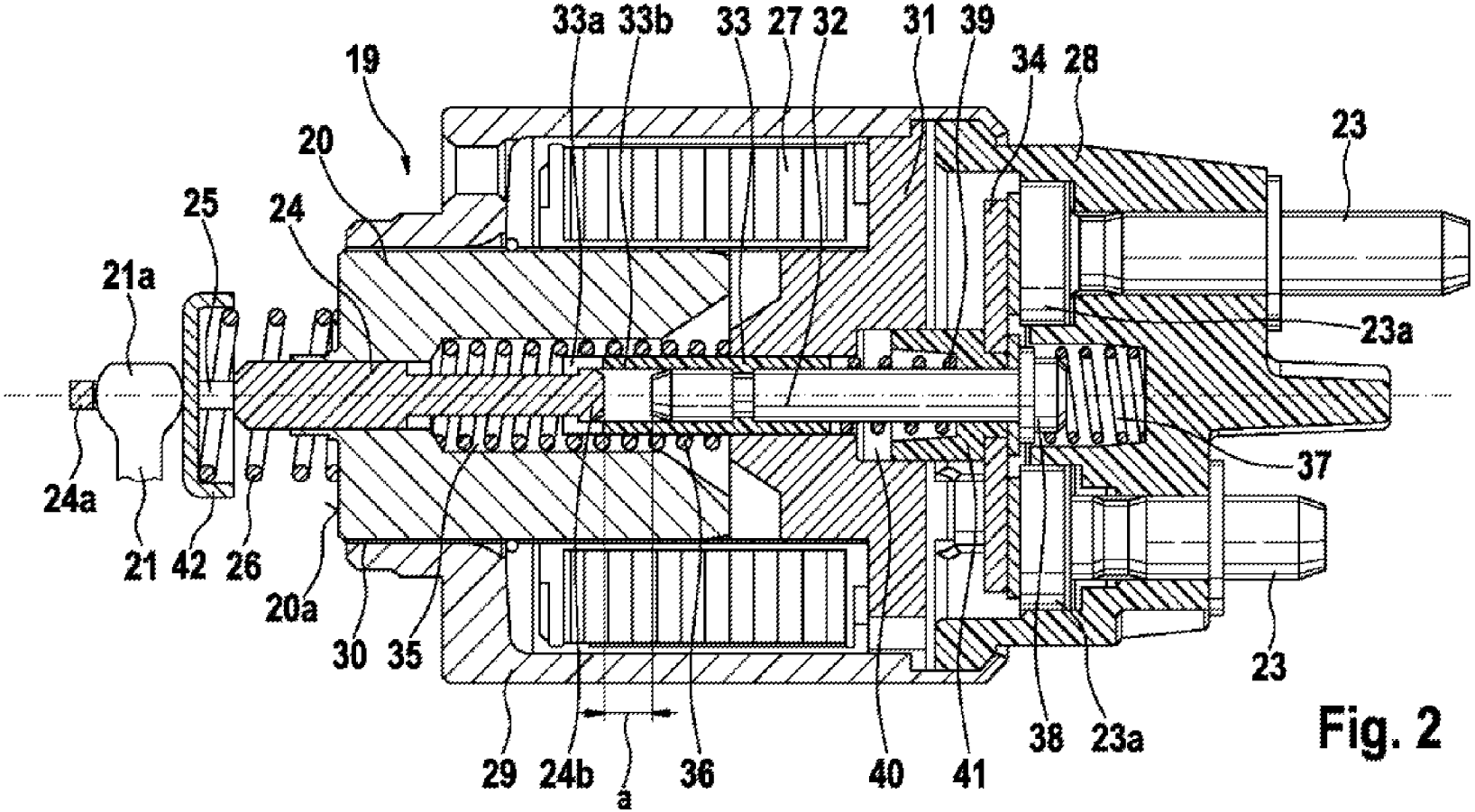
FIG. 2 shows the starter relay in longitudinal section with an additional compression spring and the magnet armature in the position before welded switching contacts are broken apart.

FIG. 2 shows the construction of the starter relay 19 from FIG. 1 in longitudinal section. It has a relay coil 27, which is connected by way of a terminal in a switch cover 28 to a starter switch (not shown) in the motor vehicle, on the one hand, and to the housing 29 of the starter relay, on the other hand. The relay coil 27 is first of all inserted into the pot-shaped housing 29 together with a brass sleeve 30 and a magnet core 31. The magnet armature 20, which plunges into the relay coil 27, is guided axially in an opening in the end of the housing 29. Secured in a central hole in the magnet armature 20 is the driver 24, the axially outward-projecting end region 24*a* of which is provided with the punched aperture 25, forming a "paddle" to receive the forked lever 21. A switching spindle 32 is guided by means of an insulating sleeve 33 in a through opening in the magnet core 31. A contact bridge 34 is mounted in an axially displaceable manner on the outer end of the switching spindle 32. The housing 29 of the starter relay 19 is closed off by the switch cover 28. The ends of the contact studs 23, which project into the interior of the switch cover 28, are designed as switching contacts 23*a*, which interact with the contact bridge 34. In the rest position of the relay, the inner end of the switching spindle 32 is opposite the end of the driver 24, with a clearance a. Inserted between the magnet core 31 and the magnet armature 20 is an armature reset spring 36, one end of which is supported on the end face of the magnet core 31 and the other end of which is supported on the bottom of a recess 35 in the magnet armature 20. In the switch cover 28 there is a contact reset spring 37, one end of which is supported on the end of the switch cover 28 and the other end of which is supported on a support washer 38 secured on the outer end of the switching spindle 32. A contact pressure spring 39 is situated in an axial blind hole 40 in the magnet core 31. One end of this spring is supported by way of an insulating cap 41 on the contact bridge 34 and the other end is supported on the end face of the insulating sleeve 33. All three springs are preloaded, the more strongly preloaded contact reset spring 37 tending to push the contact bridge 34 into the rest position counter to the preloading of the contact pressure spring 39.

In the case of the starter relay 19 shown in FIG. 2, the insulant sleeve 33, which is secured positively on the switching spindle 32, is designed in the front section as a coupling 33*b*, which connects the switching spindle 32 and the magnet armature 20 to each other in such a way that they can be displaced to a limited extent with respect to each other. This is achieved by virtue of the fact that the driver 24 is designed as a head 24*b* at its inner end, which projects into the recess 35 in the magnet armature 20. This head 24*b* is surrounded by a plurality of claws 33*a* formed at the end of the coupling 33*b*.

FIG. 2, which shows the position before welded contacts are broken apart, will now be used to explain how a weld between the switching contacts 23*a* and the contact bridge 34 is broken apart again. During the starting phase, the magnet armature 20 is pulled against the magnet core 31 by a magnetic force due to the magnetic field of the energized relay coil 27. During this process, the preloaded armature reset spring 36 is subjected to an increased load, and, after crossing the clearance a, the driver 24 pushes the switching spindle 32 to the right, with the result that the contact bridge 34 is raised and finally touches the switching contacts 23*a*. During this process, the contact reset spring 37 is subjected to an increased load. In the last part of the armature travel, the switching spindle 32 is then pushed somewhat further counter to the force of the contact reset spring 37 to allow for the "contact erosion" and this imposes an additional load on the likewise preloaded contact pressure spring 39 until, finally, the the magnet armature 20 rests against the end face of the magnet core 31. If small areas of the switching contacts 23*a* weld to the contact bridge 34 in the case of an uneven contact surface and a high current load, the force of the contact reset spring 37 is not sufficient to break such a weld apart when the starter relay 19 is switched off. The coupling 33*b* formed on the insulant sleeve 33 of the switching spindle 32 now ensures that, when the starter relay 19 is switched off, the magnet armature 20 is accelerated by the force of the armature reset spring 36 on its way into the rest position by virtue of the fact that it initially travels unhindered by a distance corresponding to the clearance a between the switching spindle 32 and the driver head 24*b*. By means of the kinetic energy received during this process, the switching spindle 32 is then taken along by the head 24*b* of the driver 24 by means of the claws 33*a* of the insulant sleeve 33, as illustrated in FIG. 2. With the aid of this kinetic energy and the additional force of the contact reset spring 37, the weld between the switching contacts 23*a* and the contact bridge 34 is broken apart. The contact bridge 34 is then pushed by the force of the contact reset spring 37 into the rest position, in which the insulating cap 41 of the contact bridge 34 is supported on the bottom of the blind hole 40 in the magnet core 31. The magnet armature 20 is furthermore pushed by the armature reset spring 36 into its rest position, which is defined by the rear stop of the engagement device 50 on the starting device 10.

The helical compression spring 26, one end of which is supported via a cupped washer 42 on the head end 21*a* of the forked lever 21 and the other end of which is supported on the end face of the magnet armature 20, ensures that the head end 21*a* of the forked lever is in continuous contact with the outer end wall 25*a* of the punched aperture 25 by virtue of the preloading force of the helical compression spring 26. By means of this measure, it is now possible, using the insulant sleeve 33, to form the coupling 33*b* at the switching spindle 32 and the driver 24 in such a way that breaking apart of welded switching contacts 23*a* by the magnet armature 20 is ensured over the entire range of manufacturing tolerances by means of a relatively small clearance a. Without this helical compression spring 26, by contrast, the head end 21*a* of the forked lever would be supported on the inner end wall 25*b* of the punched aperture 25 when the starter relay 19 was switched off, with the result that, when the starter relay 19 was switched off, the contact bridge 34 would be pushed into the rest position and would hold the magnet armature 20, by way of the switching spindle 32 and the insulant sleeve 33, in the rest position it had reached after being accelerated by the armature reset spring 36 and crossing the clearance a, even though the engagement device 50 of the starting device 10 might not have reached its rest position. Given unfavorable manufacturing and assembly tolerances, this could prevent the starter pinion 16 from being disengaged to a sufficient extent from the ring gear 18. Thus, with the aid of the helical compression spring 26, both breaking apart of welded switching contacts 23*a* and reliable disengagement of the starter pinion 16 as far as the rear stop of the engagement device 50 is achieved over the entire range of manufacturing and adjustment tolerances. In order to prevent the armature reset spring 36 from pushing the magnet armature 20 into the rest position counter to the force of the helical compression spring 26 and thereby giving rise to play between the punched aperture 25 in the driver 24 and the head end 21*a* of the forked lever 21 in the case where the rest position of the engagement device 50 is reached earlier than the rest position of the magnet armature 20, the helical compression spring 26 is designed in such a way that the pressure force of the helical compression spring 26 is greater in the rest position of the starter relay 19 than the resetting force of the armature reset spring 36.

Figure 3:
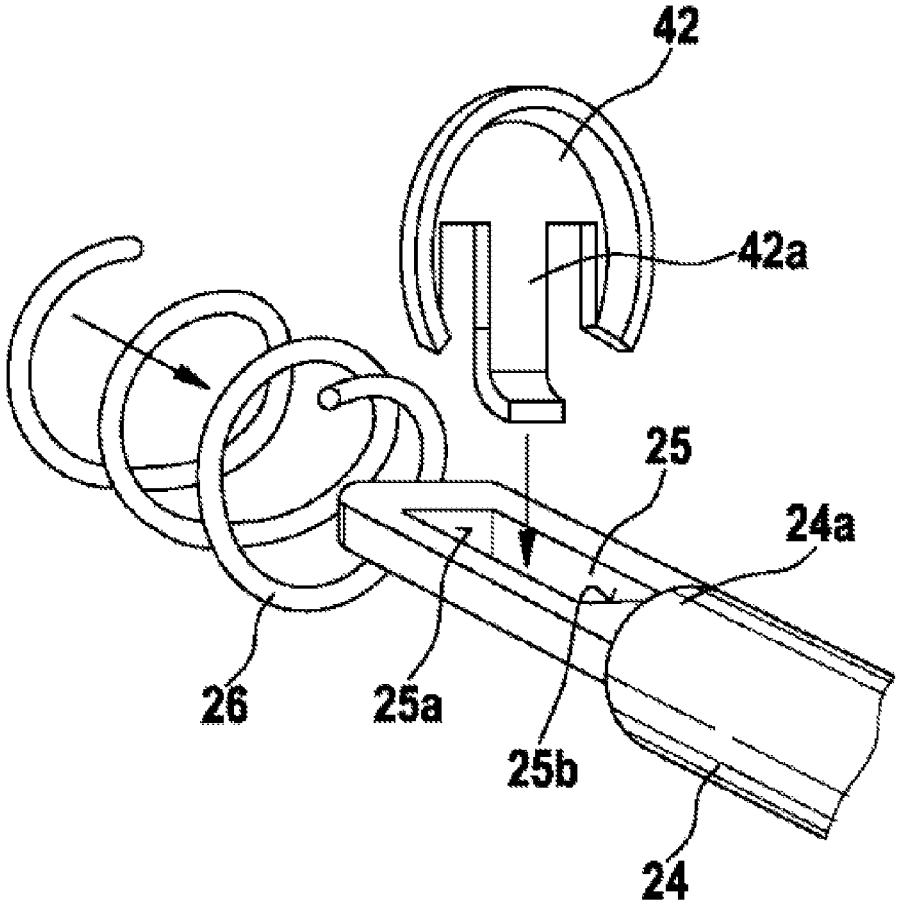
FIG. 3 shows the pre-mounting of the compression spring and the cupped washer on the driver of the starter relay in a three dimensional enlarged representation.

FIG. 3 shows the pre-mounting of the helical compression spring 26 on the rear end region 24*a* of the driver in an enlarged three-dimensional representation. This pre-mounting is required because the starter relay 19 is produced as a separate component of the starting device 10. In the process of pre-mounting, the helical compression spring 26 is first of all pushed axially from the outside onto the end region 24*a* of the driver 24 shown in FIG. 2 in the direction of the arrow, and thus rests by one end against the end face of the magnet armature 20. The helical compression spring 26 is then compressed axially and is thus under a preload. The cupped washer 42 is then placed on the paddle-shaped end region 24*a* from above in the direction of the arrow, with a finger 42*a* punched out of the central area of the cupped washer 42, leaving it free on both sides as far as the cup edge, reaching from above through the punched aperture 25 in the driver 24. The cupped washer 42 is then mounted on the free end of the helical compression spring 26. When the helical compression spring 26 is released, it then presses the cup spring 42 against the outer end wall 25*a* of the punched aperture 25 by way of the punched-out finger 42*a* in the pre-mounted state.

Figure 4:
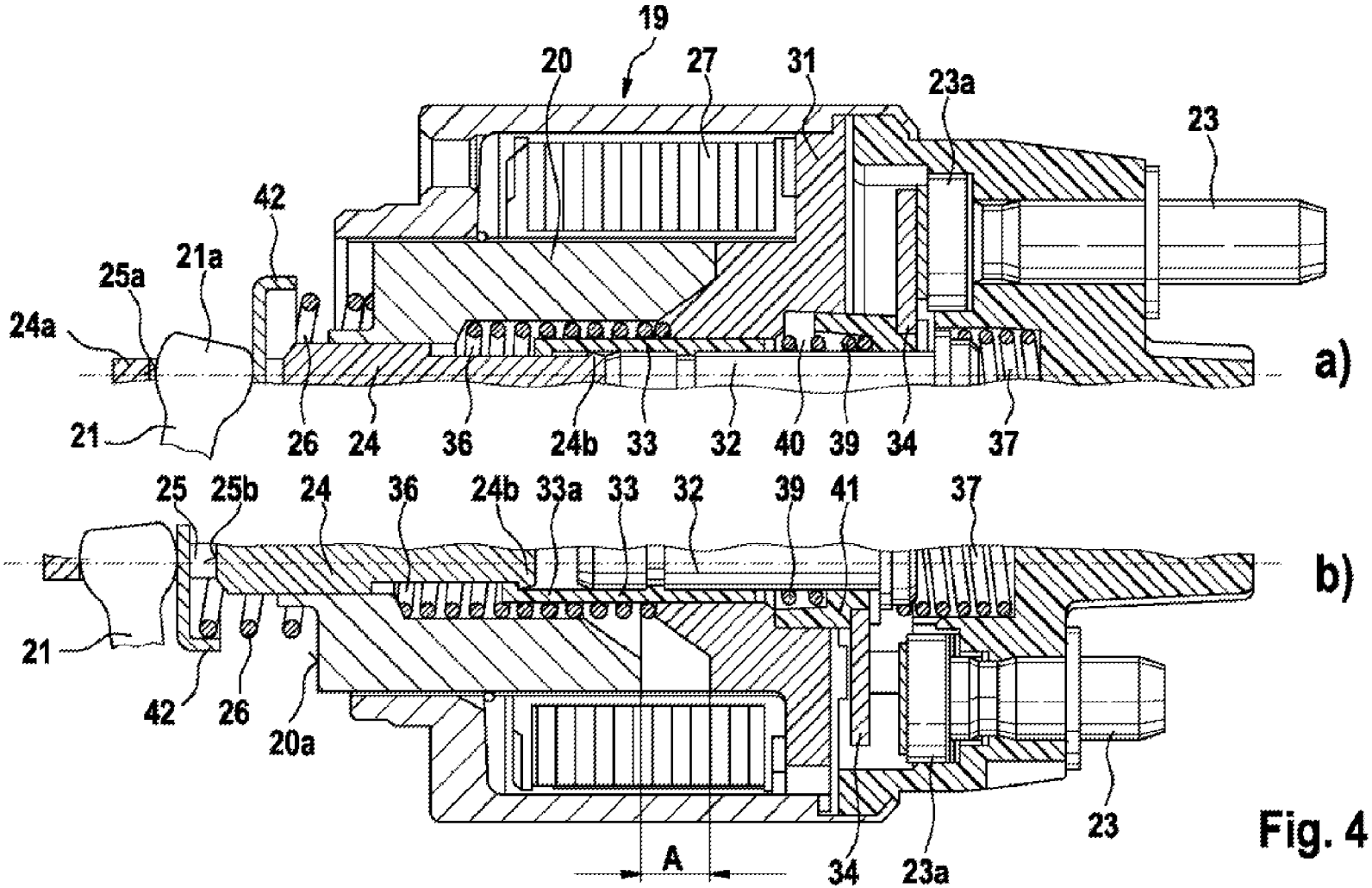
FIG. 4 shows the starter relay in longitudinal section with an upper part a) illustrated in the working position and a lower part b) in the rest position.

FIG. 4 shows the starter relay 19 from FIG. 2, which is divided into two halves, each shown in longitudinal section. In the upper part a) of FIG. 4, the starter relay 19 is in the working position, in which the magnet armature 20 is pressed against the armature core 31 by the magnetic field of the energized relay coil 27 counter to the force of the armature reset spring 36 and rests against its end face. During this process, the head 24*b* of the driver 24 has pushed the switching spindle 32 to the right counter to the force of the contact reset spring 37 until the contact bridge 34 rests against the switching contacts 23*a* of the contact studs 23. Moreover, the switching spindle 32 is pushed a little further to the right by the driver 24 of the magnet armature 20, counter to the contact pressure spring 37, owing to the "erosion allowance", as a result of which the contact pressure spring 39 is also subjected to additional load. The forked lever 21 of the starting device 10 according to FIG. 1 is pivoted to the right until the starter pinion 16 has fully engaged in the ring gear 18 of the internal combustion engine. During this process, the head 21*a* of the forked lever 21 is pressed against the outer end wall 25*a* of the punched aperture 25 in the driver 24 by the helical compression spring 26 by means of the cupped washer 42.

The lower part b) of FIG. 4 shows the lower half of the starter relay 19 in longitudinal section, which shows the rest position of the relay when the relay coil 27 is switched off. Here, the force of the contact reset spring 37 pushes the switching spindle 32 back counter to the force of the contact pressure spring 39 until the contact bridge 34 reaches its rest position. This position is reached as soon as the insulating cap 41, as the support for the contact bridge 34, is resting on the bottom of the blind hole 40 in the magnet core 31. With the slackening of the magnetic force, the loaded armature reset spring 36 simultaneously pushes the magnet armature 20 to the left until the head 24*b* of the driver 24 is securely held axially by the coupling claws 33*a* of the insulant sleeve 33.

During this process, the forked lever 21 is pivoted to the left, thereby disengaging the starter pinion 16 from the ring gear 18 of the engine. At the same time, the head 21*a* of the forked lever 21 is pushed to the left by the compression spring 26 by way of the cupped washer 42 until the engagement device 50 from FIG. 1 has reached its rear stop on the steep-pitch thread 13.

The manufacturing and installation tolerances should never be so great that, when the rest position of the magnet armature 20 is reached in accordance with FIG. 4, part b), the starter pinion 16 of the starting device 10 from FIG. 1 has not yet disengaged from the ring gear 17 of the engine by the required safety clearance. Ideally, the rest position of the magnet armature 20 and the rest position of the engagement device 50 of the starting device 10 are reached simultaneously. However, the case in which a rest position of the engagement device 50 is reached earlier than the rest position of the magnet armature 20 is uncritical too. To accommodate such cases, the helical compression spring 26 is designed in such a way that, in the rest position of the starter relay 19, the pressure force of the helical compression spring 26 is greater than the resetting force of the armature reset spring 36. The result is that the head 21*a* of the forked lever 21 remains in contact with the outer end wall 25*a* of the punched aperture 25 even in this case.

Another limiting case can occur if, when a starting attempt has failed, the relay coil 27 is switched off but the starter pinion 16 nevertheless remains in the engagement position. To enable the starter motor 11 to be switched off reliably, even in such a case, the helical compression spring 26 is furthermore designed in such a way that the pressure force thereof in the switched-on position of the starter relay 19 is less than the resetting force of the contact reset spring 37 and the armature reset spring 36 acting on the magnet armature 20. In this case, when the relay coil 27 is switched off, the magnet armature 20 is moved to the left by the force of the armature reset spring 36 and the contact reset spring 37 counter to the force of the helical compression spring 26 until the head 21*a* of the forked lever 21 strikes against the inner end wall 25*b* of the punched aperture 25. The distance traveled by the driver 24 during this process is sufficient to raise the contact bridge 24 from the switching contacts 23*a* beyond the "erosion allowance" and hence to interrupt the circuit for the starter motor 11. In the stationary condition, the starter pinion 16 can be effortlessly disengaged fully from the ring gear 18 of the engine by the starter relay 19.

In the rest position illustrated in FIG. 4*b*, the magnet armature 20 has assumed its maximum working air gap A with respect to the magnet core 31, this air gap being larger by the "erosion allowance" of the relay than the clearance a indicated in FIG. 2 between the driver 24 and the switching spindle 31. The use of the helical compression spring 26 now makes it possible to choose a smaller maximum working air gap A than is the case with starter relays without such a compression spring since the helical compression spring 26 can now pivot the forked lever 21 further to the left in the rest position. The resistance of the forked lever in the rest position means that the magnet armature plunges deeper into the relay coil. This measure increases the magnetic pull-in force on the starter relay 19 at the beginning of the movement of the armature out of the rest position.

The invention is not restricted to the embodiment illustrated and described. Thus, it is quite possible, within the scope of the invention, to modify the design of the coupling provided between the switching spindle 32 and the magnet armature 20 for the purpose of breaking apart welded relay contacts, as is known inter alia from printed publication DE 102 60 843 A1. The feature of essential significance to the invention, however, is the combination of such a coupling with a compression spring 26 between the armature end face of the starter relay 19 and the head of the forked lever 21 of the starting device 10 in order to avoid the two critical limiting cases described at the outset in the tolerance range of the manufacturing, adjustment and assembly tolerances.

The invention claimed is:

1. A starter relay (19) of a starting device (10) for internal combustion engines, the starter relay comprising a relay coil (27) and a magnet armature (20), which can be moved out of a rest position into a working position counter to a force of an armature reset spring (36) by energization of the relay coil and which interacts with one end of a forked lever (21) by way of an axially outward-projecting driver (24) so as to pre-engage a starter pinion (16), and comprising a contact bridge (34), which can be actuated by the magnet armature by way of a switching spindle (32) and interacts with switching contacts (23*a*), wherein a coupling (33*b*) connects the switching spindle and the magnet armature in such a way that they can be displaced to a limited extent with respect to each other, characterized in that a preloaded compression spring (26) is inserted between the magnet armature (20) and the end (21*a*) of the forked lever (21), characterized in that a pressure force of the compression spring (26) in the rest position of the starter relay (19) is greater than the resetting force of the armature reset spring (36), and in that the pressure force of the compression spring (26) in the working position of the magnet armature (20) is less than the resetting force of a contact reset spring (37) and the armature reset spring (36) acting on the magnet armature (20).

2. The starter relay as claimed in claim 1, characterized in that the compression spring (26) is a helical compression spring mounted axially on the driver (24).

3. The starter relay as claimed in claim 2, characterized in that the helical compression spring (26) is supported at one end, via a cupped washer (42), on a head (21*a*) of the forked lever (21), said head projecting into a punched aperture (25) in the driver (24), and is supported at an other end on an end face (20*a*) of the magnet armature (20).

4. The starter relay as claimed in claim 3, characterized in that a finger (42*a*), which reaches from above through the punched aperture (25) in the driver (24), is punched out in a central area of the cupped washer (42), leaving the finger free on both sides as far as a cup edge.

5. The starter relay as claimed in claim 4, characterized in that, in a pre-mounted condition, the helical compression spring (26) on the starter relay (19) presses the cupped washer (42) against an outer end wall (25*a*) of the punched aperture (25) in the driver (24) via the punched-out finger (42*a*).

6. The starter relay as claimed in claim 4, characterized in that the compression spring (26) is coaxial with the armature reset spring (36).

* * * * *